US006887528B2

(12) United States Patent
Lau et al.

(10) Patent No.: US 6,887,528 B2
(45) Date of Patent: May 3, 2005

(54) HIGH TEMPERATURE ABRADABLE COATINGS

(75) Inventors: Yuk-Chiu Lau, Ballston Lake, NY (US); Farshad Ghasripoor, Scotia, NY (US); Robert Anthony Fusaro, Jr., Schnectady, NY (US); Raymond Edward Chupp, Glenville, NY (US); Donald Joseph Baldwin, Middle Grove, NY (US); Canan Uslu Hardwicke, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/320,480

(22) Filed: Dec. 17, 2002

(65) Prior Publication Data

US 2004/0115351 A1 Jun. 17, 2004

(51) Int. Cl.[7] ..... C23C 4/02; C23C 4/04
(52) U.S. Cl. ..... 427/448; 427/454; 427/456
(58) Field of Search ..... 427/448, 453, 427/454, 456

(56) References Cited

U.S. PATENT DOCUMENTS 4,874,290 A * 10/1989 Cang et al. ..... 415/173.4
4,914,794 A * 4/1990 Strangman ..... 29/889.2
5,756,217 A * 5/1998 Schroder et al. ..... 428/469
5,951,892 A * 9/1999 Wolfla et al. ..... 219/121.69
6,086,327 A * 7/2000 Mack et al. ..... 415/160

FOREIGN PATENT DOCUMENTS

CA 2326992 * 6/2001

* cited by examiner

*Primary Examiner*—Kathering Bareford
(74) *Attorney, Agent, or Firm*—Nixon & Vanderhye P.C.

(57) ABSTRACT

Method of producing a profiled abradable coating on a substrate in which an abradable ceramic coating composition is applied to a substrate using direct-write technology, or plasma sprayed onto the substrate through a mask or by use of a narrow foot-print plasma gun. These methods of producing abradable coatings are performed in the absence of a grid.

9 Claims, 7 Drawing Sheets

Rub-tested (c) chevron sample, and (d) squared diamond samples

HIGH TEMPERATURE ABRADABLE COATINGS

The present invention relates generally to high temperature abradable coatings. More specifically the invention provides high temperature profiled abradable coatings for stationary shrouds for turbine stages with unshrouded blades tips without tipping. In order to abrade high temperature abradables, particularly ceramic abradables, reinforcing the blade tip with a high temperature material becomes a necessity. In such cases, materials such as cubic boron nitride, silicon carbide or similar materials are used either in the form of entrapped coarse grits or a fine coating applied by a process such as, for example, thermal spray process, direct-write technology, physical or chemical vapor deposition.

BACKGROUND OF THE INVENTION

It is well known to use materials which abrade readily to form seals between a rotating part and a fixed part, whereby the moving part erodes a portion of the abradable material to form a seal having a very close tolerance. An important application of abradable seals is in gas turbines, in which a rotor consisting of a plurality of blades mounted on a shaft rotates inside a shroud. By minimizing the clearance between the blade tips and the inner wall of the shroud, it is possible to reduce leakage of gas across the blade tip and thereby maximize turbine efficiency. This may be achieved by coating the inner surface of the turbine shroud with an abradable material, so that rotation of the blades and contact with inner surface causes wear of the abradable material to form grooves in the abradable coating. As the turbine blades rotate, they expand due to centrifugal effects as well as heat expansion. The differential expansion rate between the rotor and the inner shroud results in the tips of the blades contacting the abradable material and carve precisely defined grooves in the coating without contacting the shroud itself. In this way, an essentially custom-fitted seal is provided for the turbine.

Typically, high temperature abradable coatings comprise a continuous porous ceramic coating, e.g., yttria stabilized zirconia, applied to the shroud. The blade tip is coated/reinforced with abrasive grits such as cubic boron nitride (cBN). Drawbacks of this system are the short life of the cBN at these high temperatures and the complexity of the tipping process. See, for example, U.S. Pat. No. 6,194,086 or 5,997,248.

U.S. Pat. No. 6,251,526B1 describes profiled abradable ceramic coating systems, in which a porous ceramic coating is deposited onto a substrate with a profiled surface, e.g., a metal grid brazed onto the substrate surface (FIG. 1), to form an abradable profiled surface. The profiled surface can be made in different forms as described in U.S. Pat. No. 6,457,939B21. However, a drawback of this method is that since the grid is brazed onto the substrate permanent damage can result to the shroud upon profiling.

A need exists for an abradable coating system that will not require blade tipping and will not have to be profiled through a destructive method such as brazing a grid structure. The present invention seeks to fill that need.

BRIEF DESCRIPTION OF THE INVENTION

It has now been discovered that it is possible to provide an abradable coating system that does not require blade tipping, and in which profiling of the substrate surface does not result in damage or destruction of the substrate. In particular, in one aspect, the invention utilizes direct write technology described in more detail below. In another aspect, the invention does not utilize a grid or web bonded or brazed to the substrate, such that profiling of the abradable coating does not result in destruction or damage to the substrate. The invention is applicable to many land-based as well as aviation or marine turbine components and also to the repair of serviced components.

In one aspect, the present invention provides a method of producing a profiled abradable coating on a substrate comprising thermal spraying, e.g., plasma spraying, an abradable ceramic or metallic coating composition through a mask onto a substrate in the absence of a grid.

In another aspect, there is provided a method of producing a profiled abradable coating on a substrate comprising thermal spraying, e.g., plasma spraying, an abradable ceramic coating composition onto a substrate using a narrow foot-print plasma gun which is manipulated by a robot to create the desirable pattern.

In another aspect, there is provided a method of producing a profiled abradable coating on a substrate comprising thermal spraying, e.g., air plasma spraying or HVOF spraying, a profiled metallic bond coat of composition such as MCrAlY where M can be Ni, NiCo, CoNi or Fe, through a mask or using a narrow foot-print plasma gun onto a substrate followed by plasma spraying a ceramic topcoat which will conform to the profiled pattern of the bond coat to form a profiled abradable surface.

In a further aspect, the present invention provides a method of producing a profiled abradable coating on a substrate comprising applying an abradable ceramic or metallic coating composition directly to a substrate employing direct-write technology. This rapid prototyping method does not require any mask to manufacture the profiled pattern which is stored as a CAD/CAM file in a computer.

The profiled coatings produced by the methods of the invention also form an aspect of the invention.

The present invention is particularly applicable to high temperature (≧1700° F.) abradable coating systems employed for turbine shrouds. Examples include F-class S1 shrouds. The turbine shroud can be made of a superalloy or a Si-based ceramic matrix composite.

The coating system has the advantages of long life (up to 24000 hours) at ≧1700° F., no or minimal blade/bucket wear, and no requirement for blade/bucket tipping. This results in reduced hot gas leakage over the blade tips and improved turbine efficiency.

DETAILED DESCRIPTION OF THE INVENTION

Figure 1B:
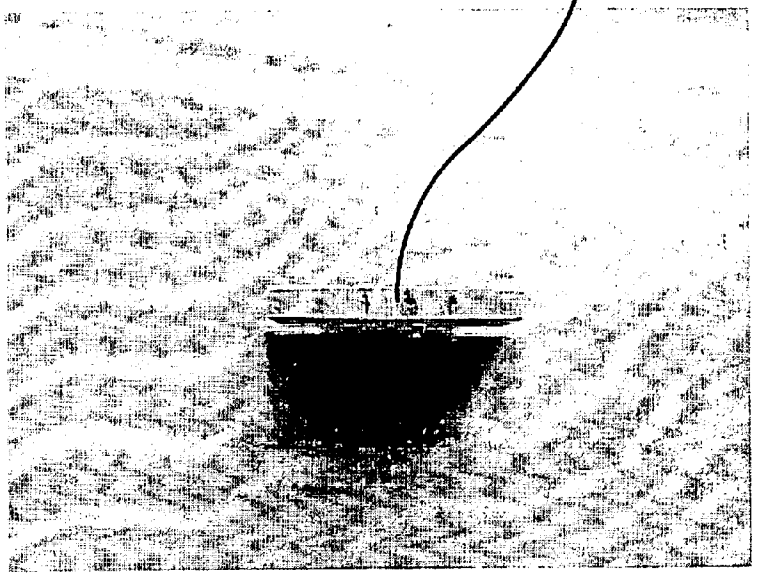
FIG. 1(*a*) shows a typical prior art porous TBC applied on a metal substrate surface with a metal grid brazed onto the substrate surface, and FIG. 1(*b*) depicts a blade tip showing minimal wear (the rub test was performed at 1830° F.); the blade in this test was not coated with abrasive coating.
Figure 1A:
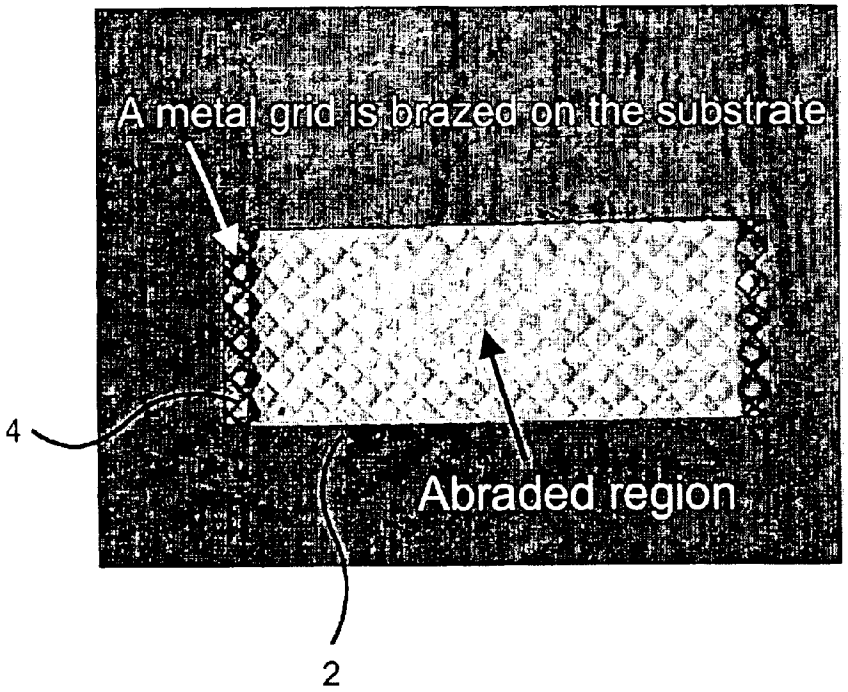

Referring to the figures, FIG. 1(*a*) shows a typical prior art porous thermal barrier coating (TBC) 2 applied on a metal substrate surface with a metal grid 4. FIG. 1(*b*) depicts a blade tip 6 showing minimal wear (the rub test was performed at 1830° F.).

Figure 2:
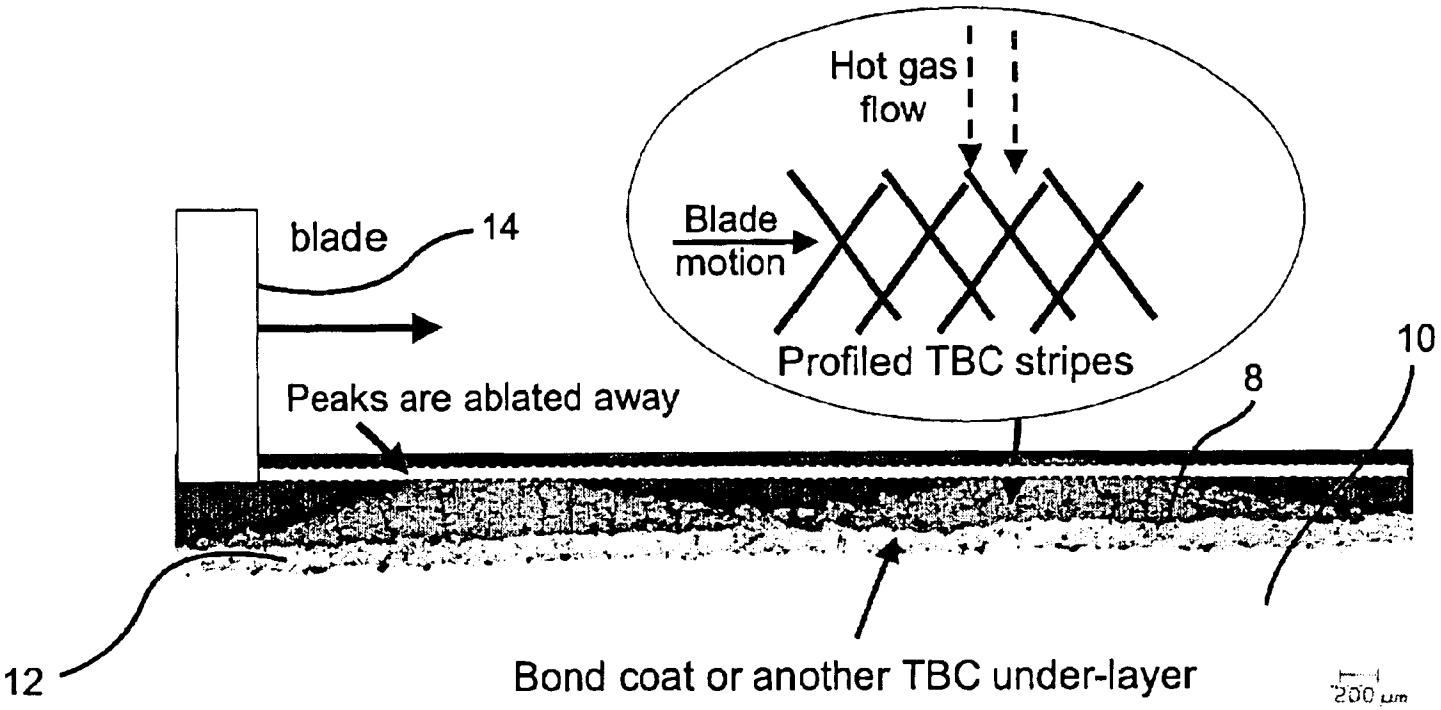
FIG. 2 shows profiled abradable ceramic coatings of the invention.

FIG. 2 shows a profiled abradable ceramic coating 8 of the invention, where the profiled abradable coating is applied onto the substrate 10 without destructively altering the substrate surface structure. Coating 12, which can be a metallic bond coat such as MCrAlY, or another ceramic layer such as YSZ or barium strontium aluminosilicate (BSAS) is shown under the abradable coating. As the blade 14 passes over the coating 8, the peaks are abraded away to provide a minimum clearance between the blade and the substrate and thus minimum leakage.

Figure 3A:
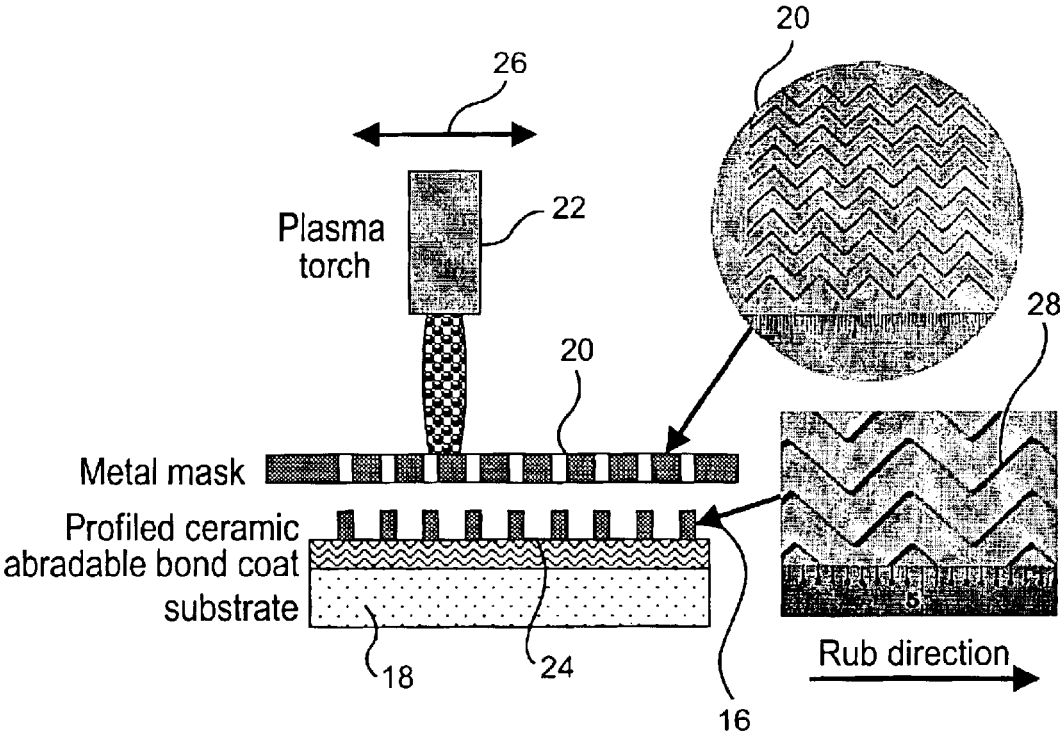
FIG. 3*a* shows a profiled ceramic abradable coating of the invention deposited by plasma spraying through a metal mask with a 90° chevron pattern.

FIG. 3*a* depicts one approach of the present invention, whereby the profiled coating 16 is applied to a substrate 18 for example a metallic bond coat or another ceramic layer such as YSZ or BSAS 24, by a thermal spray process such as air plasma spray, through a mask 20. The plasma torch 22 moves over the mask 20 as shown by the arrow 26 and the profiled coating 16 is formed on the bond coat 24. The chevron shape produced by the mask is shown at 28. A striped or honeycomb shape can also be provided.

Figure 3B:
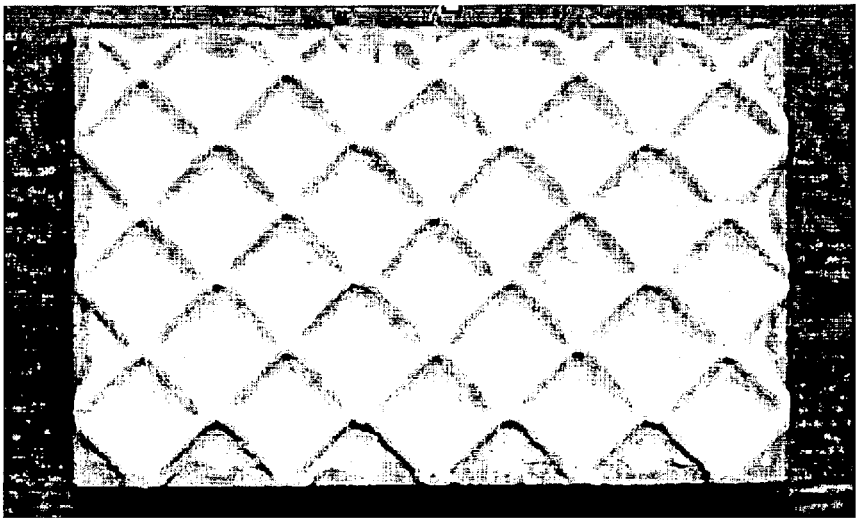
FIG. 3*b* shows a diamond-like profiled ceramic abradable coating of the invention deposited by plasma spraying first through a 90°-chevron metal mask followed by rotating the mask 180° and spraying a second 90° chevron pattern over the first one.

Alternatively, a diamond shape abradable coating, depicted in FIG. 3*b*, can be produced by a two-step spray process, i.e., first plasma spraying through a 90°-chevron metal mask followed by rotating the mask 180° and spraying a second 90° chevron pattern over the first one.

Figure 4:
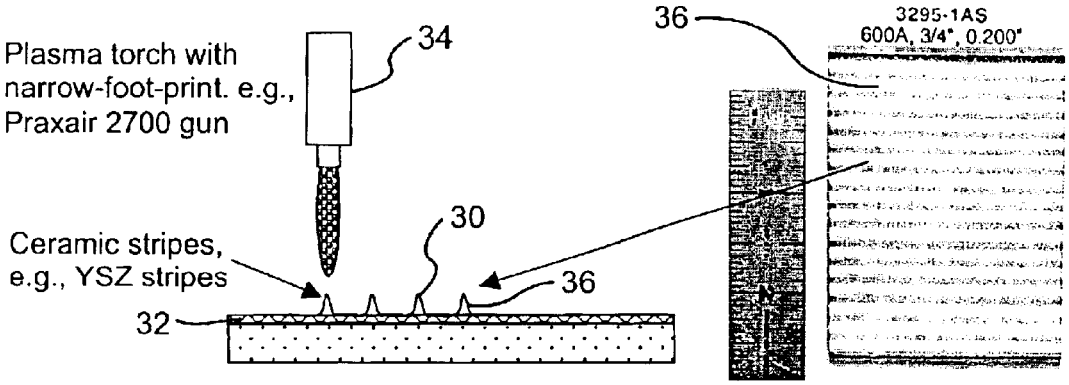
FIG. 4 shows a profiled ceramic abradable coating of the invention deposited by narrow-foot-print plasma gun, e.g., Praxair Model 2700 plasma gun.

FIG. 4 depicts an alternative approach of the present invention whereby the profiled coating 30 is applied to a substrate 32, for example a metallic bond coat or another ceramic layer such as YSZ or BSAS, by plasma spraying using a narrow-foot-print plasma gun 34. A thermal spray robot can be used to manipulate the plasma gun to form a profiled pattern. An example of a gun that may be employed for this purpose is a Praxair 2700.

The profiled abradable coating can be in the form of stripes 36 of porous ceramic coatings of yttria stabilized zirconia (YSZ) (e.g., Sulzer Metco XPT395, 7 wt % yttria stabilized zirconia with ~12 to 15 wt % polyester which will be burned off after deposition to form a porous coating) as in the case of thermal barrier coatings, or barium strontium aluminosilicate (BSAS) (with 12 wt % to 20 wt % polyester for porosity control) as in the case of environmental barrier coatings for Si-based ceramic matrix composite (CMC) components.

Figure 5:
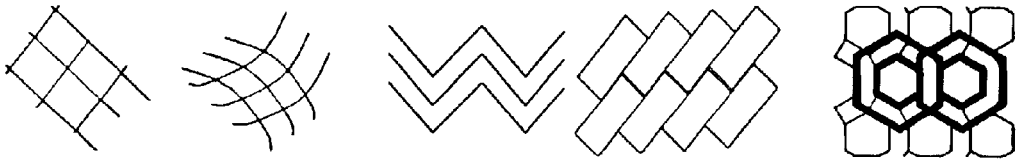
FIG. 5 shows examples of contoured stripes (straight diamond, contoured diamond, chevron, brick and honeycomb)

The pattern of the coating stripes can be optimized for both abradability and hot gas sealing. The pattern can be straight or contoured/curved diamond, or chevron 28. Examples are presented in FIG. 5, and are (from left to right) straight diamond, contoured diamond, chevron, brick and honeycomb.

Figures 6A, 6B:
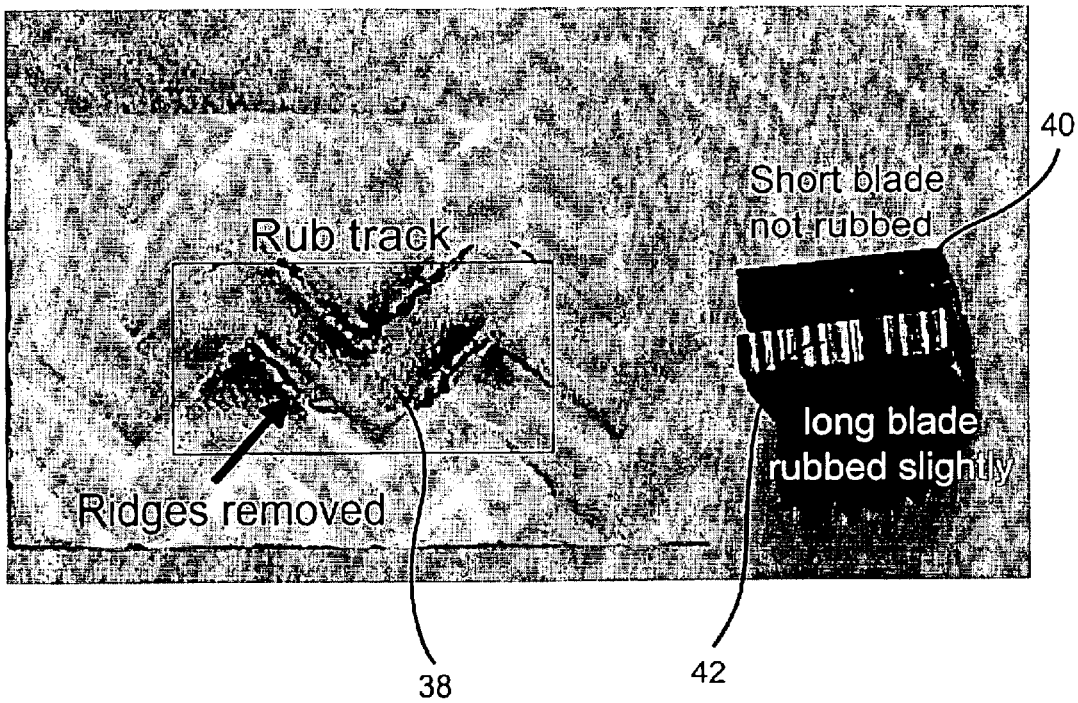
FIGS. 6*a–d* show rub-tested samples with a Chevron and squared diamond profiled ceramic abradable coating of the invention and the tested blades which were not reinforced with any abrasive coating.
Figure 6C:
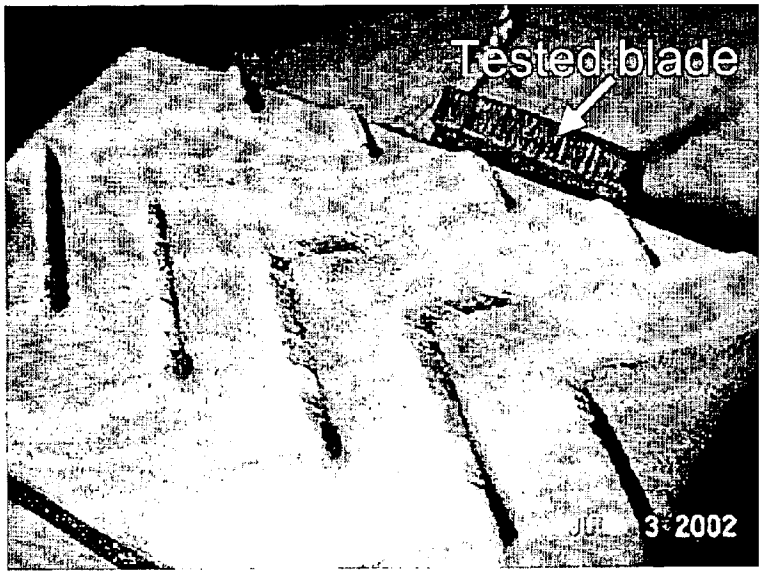

FIG. 6*a* is a rub-tested sample with a profiled ceramic abradable coating 38 of the invention and the two tested blades 40,42. In general, in order to rub without tipping, the angle of the stripes should be such that it does not form a continuous line with the squealer tip of the blade in the direction of rotation. Angles of more than 60 degrees from any point of the blade tip relative to the sliding line would be undesirable. FIGS. 6*b* and 6*c* show rub-tested samples with a Chevron and squared diamond profiled ceramic abradable coating of the invention and the tested blades which were not reinforced with any abrasive coating.

Figure 7:
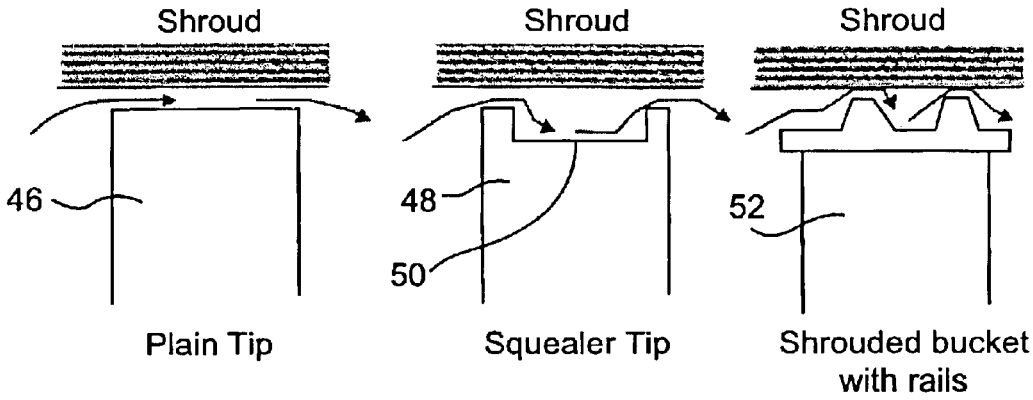
FIG. 7 shows various blade tip configurations.

FIG. 7 shows various blade tip configurations. A plain tip 46 is a flat tip and flow leaks through a constant area across the blade. A squealer tip 48 has a profile of a groove 50 which increases the area, stalls the flow creating a back pressure that restricts the flow and reduces heat transfer. The shrouded blade with rails 52 restricts flow in a similar way.

The stripes should form closed paths in the flow direction. The aim is to reduce clearance between the blade tip and the shroud. Since the abradable ceramic, for the purpose of reducing clearance, cannot be a continuous layer, it is made into intermittent ridges. The tips of the ridges provide the clearance reduction and at the same time allow abradability. The ridges, however, should block the flow of air over the blade/bucket tip. Therefore, the patterns by which the ridges are joined together are aimed at blocking the air flow. An optimum ridge pattern is one that achieves the following:

Reduced air flow over the blade/bucket tips

Least pressure losses in main core flow along the outer flow-path wall between the blade/bucket tips.

Best abradability—minimum blade/bucket tip wear w/o tip reinforcement.

Best low angle erosion resistance of the ridge walls.

(Ridge Pattern includes, height of ridge, width of ridge at the tip and the base near the substrate and the size of the cells formed by the ridges).

In a further aspect, present invention provides a method of producing a profiled abradable coating on a substrate comprising applying an abradable ceramic and/or metallic coating composition directly onto a substrate without using any masks on the substrate during deposition. There are many ways to direct-write or transfer material patterns for rapid prototyping and manufacturing on any surface. Typically, a pen dispensing apparatus is employed, such as one manufactured by OhmCraft or Sciperio. The abradable pattern applied by the apparatus is controlled by a computer which is connected to a CAD/CAM having the desired pattern. The powder is formulated to a consistency similar to that of toothpaste (usually called a fluid slurry or ink), and applied to the substrate at room temperature. The pattern is subsequently sintered at elevated temperature, as is known in the art (conventional furnace treatment or local consolidation by laser or electron beams). The powder is formulated to the appropriate consistency for application using an alcohol such as terpineol. Cellulose may also be added to impart suitable flow characteristics to the powder. This technology can be adapted to depositing on highly curved, nonplanar surfaces.

EXAMPLES

Example 1

Profiled Ceramic Abradable Coating via Plasma Spraying through Masking (FIG. 3), rub tested at 1500 F. temperature.

In this example, a metal mask was fabricated by water-jet cutting a 90° chevron pattern (as shown in FIG. 3) onto a ⅛" thick steel plate. The width of groove was 0.05" on the plasma gun side and 0.06" on the substrate side. The spacing between the grooves was about 0.2". The substrate was a 5"×5" IN718 plate which was grit-blasted with 60 mesh virgin $Al_2O_3$ grit at 60 psi air. A 0.006" thick metallic bond coat of Praxair Ni211-2 (NiCrAlY) was applied onto the substrate followed by the application of 0.04" thick profiled ceramic top coat of Sulzer Metco XPT395 (7% YSZ with 15 wt % polyester) through the metal mask (as shown in FIG. 3).

Table 1 lists the plasma and spray parameters for the bond coat and the ceramic top coat.

TABLE 1

| | Bond coat | Top coat |
|---|---|---|
| PLASMA SPRAY EQUIPMENT | | |
| GUN MFR./MODEL NO.: | METCO 7MB | |
| NOZZLE (ANODE NO.): | G | G |
| ELECTRODE (CATHODE NO.): | 7M63 | |
| ARC GAS SETTINGS | | |
| PRIMARY GAS TYPE: | N2 | N2 |
| FLOW: SCFH | 155 | 75 |
| SECONDARY GAS TYPE: | HYDROGEN | |
| FLOW: SCFH | 10 | 19 |
| POWER SETTINGS | | |
| GUN CURRENT: A | 500 | 500 |
| POWDER FEED SETTINGS | | |
| POWDER FEED RATE (LBS/HR): | 6 | 10 |
| CARRIER GAS | N2 | N2 |
| CARRIER GAS FLOW: SCFH | 13 | 10 |
| POWDER PORT NUMBER (METCO): | #2 | #2 |
| COATING DATA | | |
| STAND OFF DISTANCE: in | 5 | 4.5 |
| GUN SPEED, mm/sec | 600 | 750 |
| STEP SIZE, mm | 6 | 6 |
| ROBOT | M710i | M710i |
| COOLING AIR REQUIREMENTS: | | |
| NO. OF PLASMA GUN AIR JETS | 2 | 2 |
| PLASMA GUN AIR JET PSI | 70 | 40 |
| AUX NO. OF AIR JET REQUIREMENT: | 0 | 2 |
| PRESSURE (PSI): | N/A | 10 |

After the profiled ceramic top coat was applied, the metal mask was removed and an additional layer of ~0.002" thick ceramic top coat of Sulzer Metco XPT395 was applied over the profiled ceramic coating. After the coating operation, the polyester in the ceramic coating was burnt-off in an air furnace at ~500° C. for 4 hours.

Test samples were water-jet cut from the heat-treated substrate and rub test was performed using the GE GRC rub rig. The test conditions were: 2 untipped GTD111 (Ni-based superalloy) blade, 770 ft/sec blade tip velocity, 1500° F. test temperature and 0.0001 in/sec incursion rate. Repeated test results indicated that the test blade rubbed with a low blade wear of ~3–7% of the total incursion depth of ~0.04" and removed the ridges from the profiled ceramic top coat. FIGS. 6*a–c* show the rubbed samples and the tested blades. It must be noted that cutting the ceramic is a function of the blade tip speed, i.e., the higher the speed the better the cut due to the kinetic energy that is carried by the blade(s)/cutting element.

Example 2

Figure 6D:
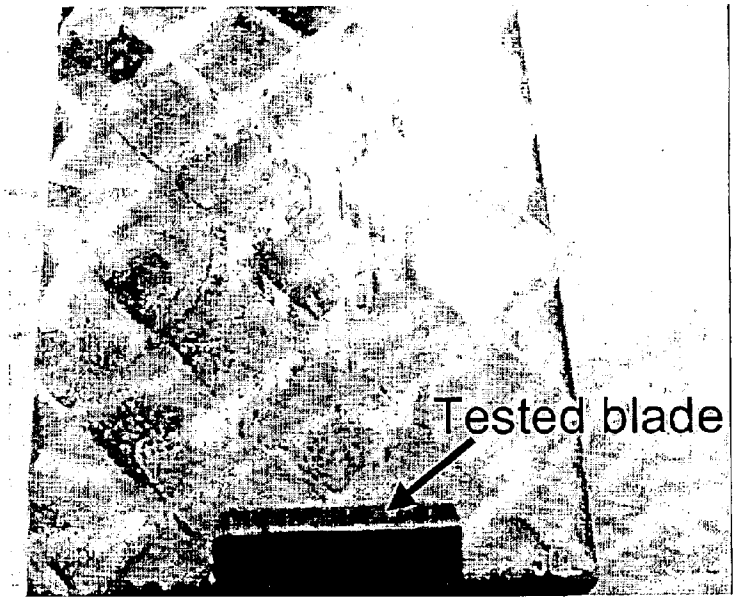

More samples were prepared with Chevron (as described in 0027) as well as diamond patterns (as described in 0016). These samples (FIG. 6) were rub tested at 1050 ft/s tip velocity, where only one untipped cutting blade of GTD111 was used. The tests were conducted at 1700 F. temperature. Test data with these samples indicate, blade wear of 0–6% of the total incursion depth of 0.04" which removed the ridges from the coatings in both types of patterns.

Example 3

Figure 8:
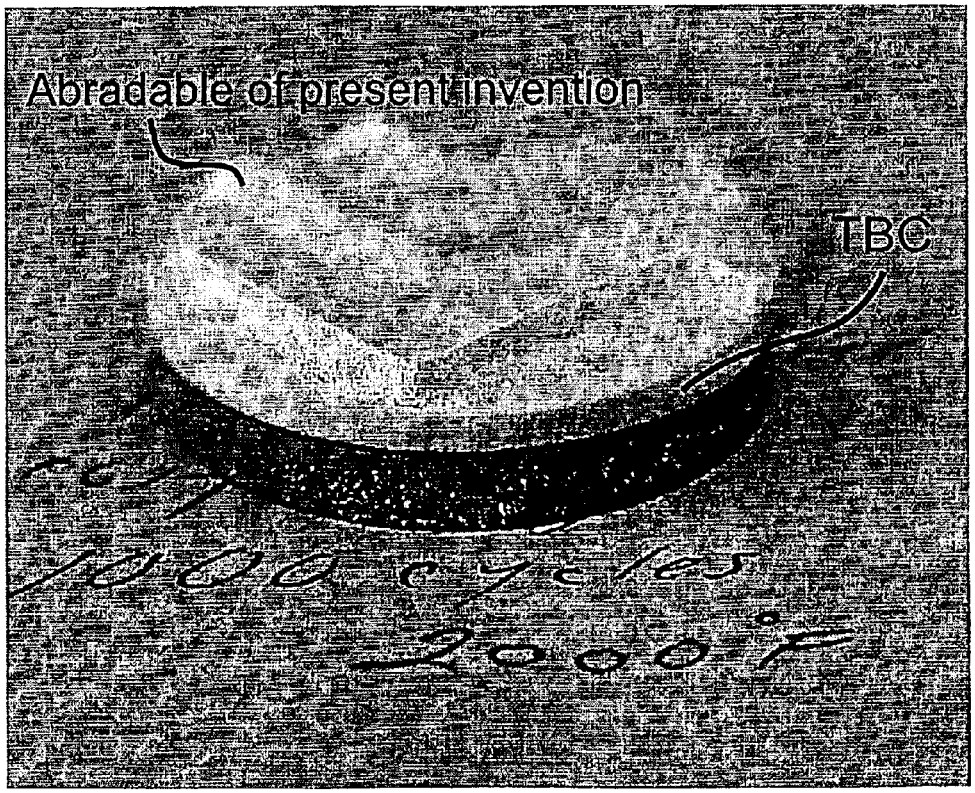
FIG. 8 shows one of the samples after 1000 furnace cycles (cycling between room temperature and 2000 F.) and there is no visual spallation of the abradable coating as well as the TBC.

More samples were prepared with Chevron pattern (as described in 0039) on previously TBC-coated Rene N5 samples. These samples were then thermal-cyclic tested in a high temperature air furnace at 2000° F. The test cycle was: ramp up to 2000 F. in 15 min., hold at 2000° F. for 45 min., and cool to room temperature in 10 min. FIG. 8 shows one of the samples after 1000 such cycles and there is no visual spallation of the abradable coating as well as the TBC. This test result indicates the compatibility of the patterned abradable coating to TBC in thermal cyclic performance.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, e.g. metallic abradable sprayed in the pattern form against unshrouded & shrouded blades with rails.

What is claimed is:

1. Method of producing a profiled abradable coating on a substrate comprising thermal spraying a profiled bond coat composition through a mask in the absence of a grid or web on the subwstrate followed by plasma spraying a ceramic or metallic topcoat composition conforming to the profiled bond coat.

2. A method according to claim 1 wherein said bond coat composition is MCrAlY where M is Ni, NiCo, CoNi or Fe and the said ceramic topcoat composition is selected from the group consisting of ytrria stabilized zirconia (YSZ) and barium strontium aluminosilicate (BSAS).

3. A method according to claim 1 wherein said substrate is a turbine shroud made of superalloy or a Si-based ceramic matrix composite.

4. A method according to claim 3 wherein said turbine shroud is a Stage 1 shroud.

5. A method according to claim 1 wherein the profiled bond coat is in the form of stripes, diamond or chevron shape.

6. A method according to claim 5 wherein the profiled bond coat is MCrAlY where M is Ni, NiCo, CoNi or Fe.

7. A method according to claim 6 wherein the profiled bond coat is MCrAlY where M is Ni.

8. A method according to claim 6 wherein the ceramic topcoat is present and is YSZ or BSAS.

9. A method according to claim 1 wherein the profiled abradable coating has a honeycomb shape.

* * * * *

UNITED STATES PATENT AND TRADEMARK OFFICE

CERTIFICATE OF CORRECTION

PATENT NO. : 6,887,528 B2
DATED : May 3, 2005
INVENTOR(S) : Lau et al.

It is certified that error appears in the above-identified patent and that said Letters Patent is hereby corrected as shown below:

Column 6,
Line 38, the word "subwstrate" should read as -- substrate. --.

Signed and Sealed this

Twentieth Day of September, 2005

JON W. DUDAS
*Director of the United States Patent and Trademark Office*